US011594842B2

(12) United States Patent
Cyzen

(10) Patent No.: US 11,594,842 B2
(45) Date of Patent: Feb. 28, 2023

(54) PLUG RETENTION SYSTEM

(71) Applicant: Keith Cyzen, Glen Ellyn, IL (US)

(72) Inventor: Keith Cyzen, Glen Ellyn, IL (US)

( * ) Notice: Subject to any disclaimer, the term of this patent is extended or adjusted under 35 U.S.C. 154(b) by 51 days.

(21) Appl. No.: 17/222,069

(22) Filed: Apr. 5, 2021

(65) Prior Publication Data

US 2021/0313741 A1 Oct. 7, 2021

Related U.S. Application Data

(60) Provisional application No. 63/005,796, filed on Apr. 6, 2020.

(51) Int. Cl.
*H01R 13/639* (2006.01)
*H01R 13/58* (2006.01)

(52) U.S. Cl.
CPC ..... *H01R 13/639* (2013.01); *H01R 13/58* (2013.01)

(58) Field of Classification Search
CPC ..... H01R 13/639; H01R 13/58
See application file for complete search history.

(56) References Cited

U.S. PATENT DOCUMENTS 5,924,895 A * 7/1999 Moji ..... H01R 24/58 439/668
7,175,474 B1 * 2/2007 Chang ..... H01R 31/06 439/501
7,384,304 B1 * 6/2008 Fawcett ..... H01R 13/6395 439/567
2004/0036442 A1 * 2/2004 Wu ..... H02J 7/0042 320/107
2005/0189911 A1 * 9/2005 Cheng ..... H01R 31/065 320/111

* cited by examiner

*Primary Examiner* — Briggitte R. Hammond
(74) *Attorney, Agent, or Firm* — Hunton Andrews Kurth LLP

(57) ABSTRACT

Retention assemblies for retaining a first end of an electrical cord in engagement with an electrical outlet are described that include an adapter with a housing having a cylindrical plug portion and retention members that extend radially outwardly from the cylindrical plug portion of the housing to engage a sidewall of the electrical outlet and cause the adapter to resist removal from the electrical outlet. The retention assemblies further include a retention housing that is configured to couple to the adapter, where the retention housing includes one or more walls that define a back opening, a front opening, and an interior sized to receive the first end of the electrical cord. The front opening includes a portion having a dimension smaller than a dimension of the first end to thereby retain the first end within the retention housing.

18 Claims, 8 Drawing Sheets

PLUG RETENTION SYSTEM

CROSS-REFERENCE TO RELATED APPLICATION

Priority is claimed to U.S. Provisional Patent Application No. 63/005,796, filed Apr. 6, 2020, and the entire contents thereof are expressly incorporated by reference herein.

FIELD OF THE DISCLOSURE

The present disclosure generally relates to plugs for electronic devices and, more particularly, to retention components for electrical outlets.

BACKGROUND

Cords to recharge and connect mobile devices have taken on many forms with advances in technology. In one current form, a cord includes a connector at a first end thereof that is configured to connect to the mobile device and another connector at a second end to connect to a power source or second electronic device. One common connector for the second end is a Universal Serial Bus (USB) connector that allows the mobile device to be connected to a computing device or power source having a corresponding port. The USB connector can also be utilized in conjunction with an adapter to plug the mobile device into a wall outlet or a vehicle's 12V auxiliary power outlet (i.e., cigarette lighter outlet) to recharge the mobile device. Unfortunately, with the increase in connections, the chance that one of the connections is inadvertently separated increases. For example, ride-sharing has become an increasing popular form of public transportation. While it may be courteous to provide riders access to a cord for charging their electronic devices during rides, the cord may become inadvertently or intentionally disconnected from the car and taken from the vehicle.

SUMMARY

In accordance with a first aspect, a retention assembly for retaining a first end of an electrical cord in engagement with an electrical outlet is described that includes an adapter including a housing having a cylindrical plug portion and retention members extending radially outwardly from the cylindrical plug portion of the housing to engage a sidewall of the electrical outlet and cause the adapter to resist removal from the electrical outlet. The retention assembly further includes an electronic assembly having a port configured to receive a plug of the first end of the electrical cord and contacts to electrically engage the electrical outlet and a retention housing configured to couple to the adapter. The retention housing includes one or more walls that define a back opening, a front opening, and an interior sized to receive the first end of the electrical cord, where the front opening includes a portion having a dimension smaller than a dimension of the first end to thereby retain the first end within the retention housing.

In some forms, the retention members can be pointed tips that are oriented radially. In further forms, the adapter can include a wedge member that is movable within the housing to drive the pointed tips radially outward to engage the sidewall of the outlet. In yet further forms, the adapter can include a fastener that is configured to couple to the housing, where coupling the fastener to the housing drives the wedge member longitudinally within the housing to drive the pointed tips radially outward. The fastener can optionally define a bore extending longitudinally therethrough to provide access to the port of the electronic assembly. In any of the above forms, the electronic assembly can include radially-extending spring arms providing an anode contact, the pointed tips can be disposed at distal ends of the spring arms, and the cylindrical plug portion of the housing can define radial slot openings configured to receive the spring arms and pointed tips therethrough.

In some forms, the retention assembly can include a drive member operably coupled to the retention members and the drive member can be configured to drive the retention members from a storage position with the retention members at least partially disposed within the cylindrical plug portion of the housing to a retention position with the retention members engaging the sidewall of the electrical outlet. In further forms, the retention members can be gripping members formed from a tacky, compressible material that are configured to shift radially outwardly to the retention position or wings pivotably mounted to the cylindrical plug portion. In any of the above forms, the drive member can be a screw that is configured to be rotated to move longitudinally through the housing to drive the retention members to the retention position.

In any of the above forms, the retention assembly can include a latch mechanism coupling the retention housing to the housing of the adapter. In some versions, the latch mechanism can include a peg of the adapter extending radially outwardly from the housing thereof and a slot opening of the retention housing having a first end open along an edge thereof and a second end extending generally along the edge, such that the retention housing and adapter can be moved relative to one another to position the peg in the second end of the slot opening to thereby restrict longitudinal movement of the retention housing away from the adapter. In yet further versions, the retention assembly can include a lock assembly that includes a threaded bore of the adapter, a through opening of the retention housing, and a fastener, where the threaded bore and the through opening align with the peg in the second end of the slot opening.

In any of the above forms, the one or more walls of the retention housing can include an end wall having the front opening extending therethrough, and the front opening can include an assembly portion sized to receive the first end or a second end of the electrical cord therethrough and a smaller, retention portion sized to receive a wire portion of the electrical cord therein, wherein the retention portion is configured to align along an axis of the port. In further forms, the retention portion can include a dome-shaped portion having a diameter generally equal to a diameter of a wired portion of the electrical cord and/or the assembly portion can be a rectangular opening.

In any of the above forms, the retention housing can include an outwardly projecting flange. In further forms, the flange can include one or more slot openings extending therethrough sized to retain the wired portion inserted therein.

In accordance with a second aspect, a method of forming a retention assembly of any of the above forms is described.

In accordance with a third aspect, a method of retaining a first end of an electrical cord in electrical coupling with a cylindrical electrical outlet is described.

DETAILED DESCRIPTION

Figure 1:
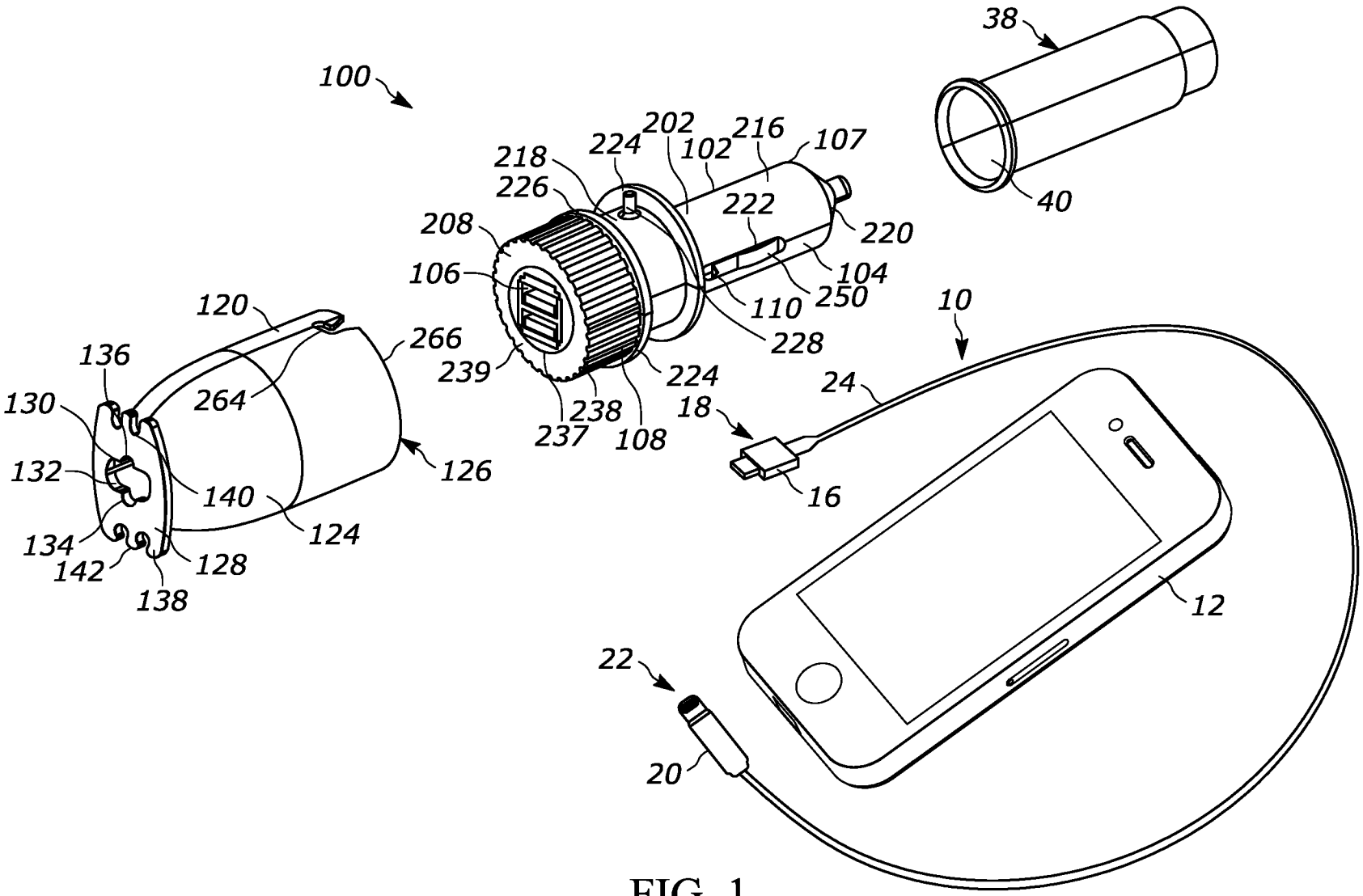
FIG. 1 is a first exploded view of an example retention assembly with an electrical cord and electrical device in accordance with various embodiments.

Retention systems and components are described herein configured to couple to a vehicle's 12V auxiliary power outlet (i.e., cigarette lighter outlet) to thereby retain power cord(s) in electrical engagement with the auxiliary outlet via a conventional 12V power plug with USB connector port. The retention components can be secured to the structure using any suitable mechanism, such as by using fastener(s), adhesive, snap fit, tongue and groove, threaded connection, and so forth. The retention components can be configured to retain power cords in electrical connection with any 12V power outlet of a vehicle such as car, boat, truck, RV, camper, etc., including outlets in dashboards, glove boxes, center consoles, trunks, and so forth. The retention components have a housing defining an interior shaped and sized to receive a plug of the power cord therein. The housing includes an opening in an outwardly facing surface to both receive the power cord therethrough and retain a wire of the power cord so that the housing can be secured to the structure and the connector of the power cord be held generally immobile within the housing.

A retention assembly is provided herein having a housing configured to retain a first, plug end of an electrical cord and an adapter to electrically couple the plug end of the electrical cord to a power outlet, such that with the housing secured to a vehicle structure, the plug end of the electrical cord and the adapter is retained between the power outlet and the housing, thereby preventing one from walking away from the wall with the entire electrical cord or adapter. The housing includes an interior sized to receive the plug end and adapter therein. In some versions, an end wall of the housing includes a through-opening having an assembly portion to allow an end of the electrical cord to pass therethrough to connect the first end to the adapter and a retention portion sized to receive a middle, wire portion of the electrical cord therein. In other versions, the retention assembly includes an insert having a slot opening to receive the wire portion of the electrical cord therethrough. The insert can then be inserted into the housing such that a sidewall of the insert extends between a front wall of the housing and the adapter to restrict movement of the first end and the adapter.

While the depicted form of the retention feature is designed and configured to accommodate standard vehicle 12V auxiliary outlet charging connectors for smart phones, tablets, PCs and other mobile or immobile devices with one or more USB ports, the retention feature could be easily modified to accommodate other power supplies. That is, most charging cords for mobile devices include a first end with a first connector for connecting to a charging or power source such as a vehicle accessory power outlet, and a second end with a second connector for plugging into a device to be charged. However, due to the proliferation of mobile devices and the need for electrically charging these devices, recent trends in electrical supply include providing USB ports in addition to or as a substitute for one of the traditional vehicle 12V auxiliary power outlets. This advantageously enables users to plug the first end of the charging cord, which includes the USB connector, directly into the USB outlet without requiring a power adapter. Thus, it should be appreciated that the present invention can be easily modified to accommodate this variation.

Figure 2:
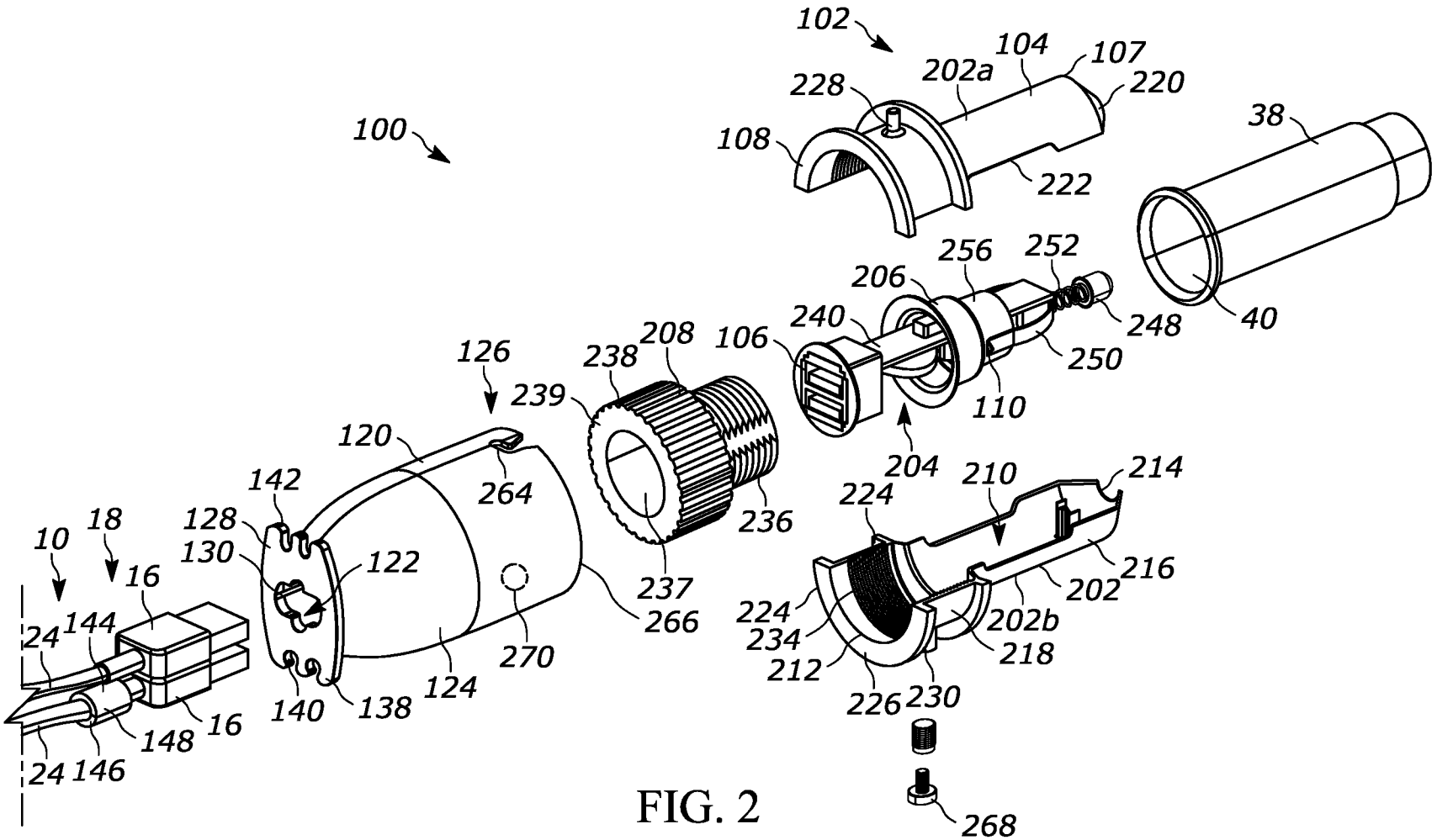
FIG. 2 is an exploded view of the retention assembly of FIG. 1.

Referring now to the figures, an example electrical cord 10 for connecting an electrical device 12 to a power source or secondary electrical device 38 is shown in FIGS. 1 and 2. In one example, the power source 38 can be a conventional cylindrical bore shaped 12V auxiliary outlet (FIGS. 1-3 and 8), typically provided in vehicles. The electrical cord 10 includes a first connector or plug 16 at a first end 18 thereof, a second connector or plug 20 at a second, opposite end 22 thereof, and a wired portion 24 extending therebetween. With many configurations, the first connector 16 has larger dimensions than the second connector 20, and both the first and second connectors 16, 18 have larger dimensions than the wired portion 24. For example, the second connector 20 can be a Lightning, mini-USB, or USB-C connector, while the first connector 16 can be a USB connector. Of course, other connectors and plugs for the first and second connectors 16, 20 can also be utilized.

Cord retention assemblies 100 are described herein that include an adapter 102 configured to be at least partially inserted into the outlet 38. The adapter 102 includes a cylindrical plug portion 104 on a first side 107 and one or more ports 106 on a second side 108 thereof. The ports 106, which can be configured for any desired plug type, such as USB, mini-USB, USC-C, etc., are configured to receive the first connector 20 of the electrical cord 10 therein. The adapter 102 further includes one or more retention members 110 that project laterally outwardly from the plug portion 104 to engage a sidewall 40 of the outlet 38 to thereby cause the adapter 102 to resist removal from the outlet 38.

The assemblies 100 further include a cord retention housing 120 that couples to the adapter 102 and has an interior 122 sized to receive and retain the first end 18 of the electrical cord 10 in electrical coupling with the adapter 102 and, through the adapter 102, with the outlet 38. The housing 120 includes a sidewall 124 defining the interior 122 and a back opening 126 to the interior 122 that is configured to align with and extend around the outlet 38 so that the adapter 26 and the first end 18 can be electrically coupled thereto. In the illustrated form, the sidewall 124 has an annular configuration, which can have an inwardly tapering curvature as shown.

Figure 3:
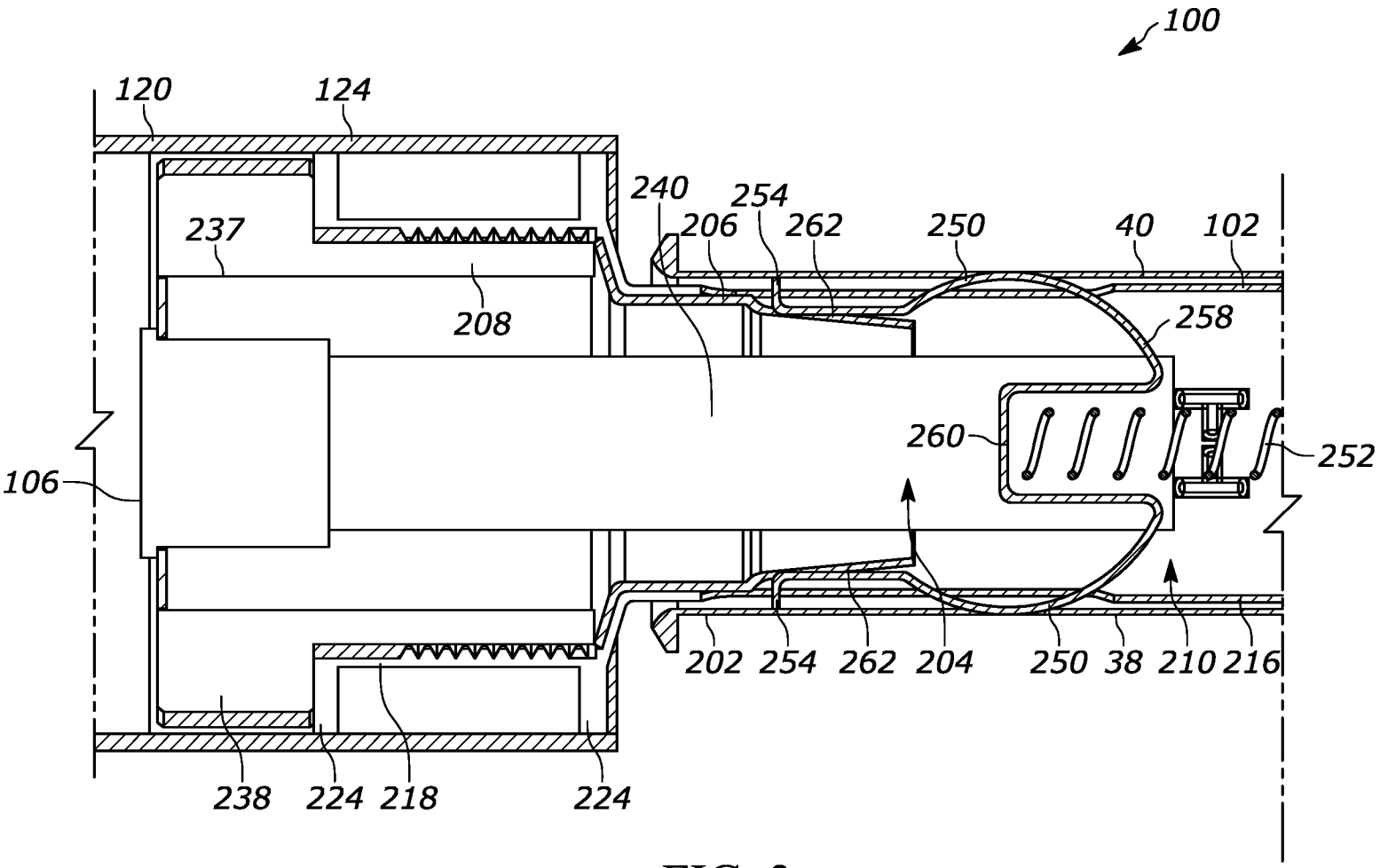
FIG. 3 is a cross-sectional view of a portion of the retention assembly of FIG. 1 showing first example retention portions.

As shown in FIGS. 1 and 2, the retention housing 108 further includes an end wall 128 opposite the back opening 126 with the sidewall 124 extending therebetween. The end wall 128 includes a front opening 130 extending therethrough to receive portions of the electrical cord 10 therethrough. As shown in FIG. 3, the front opening 130 includes an assembly portion 132 and a smaller, retention portion 134. The assembly portion 132 is relatively larger than the retention portion 134 and sized to receive one or both of the first or second ends 18, 22 of the electrical cord 10 therethrough so that the electrical cord 10 can be assembled with housing 120 prior to coupling the housing 120 to the adapter 102. If desired, the assembly portion 132 can have a shape, such as rectangular as shown, so that the first and/or second ends 18, 22 of the electrical cord 10 can only pass therethrough in a corresponding orientation. For example, in the illustrated form, the assembly portion 132 has a rectangular configuration, which can be generally complementary to a shape of the first and/or second ends 18, 22 of the electrical cord 10, with the rectangle having a larger vertical dimension than horizontal dimension. So configured, a user can insert one of the first or second ends 18, 22 through the assembly portion 132 of the front opening 130 with the end 18, 22 oriented vertically.

Conversely, the relatively smaller retention portion 134 is sized to receive the wired portion 24 therein while also having at least one dimension smaller than a corresponding dimension of the first and second ends 18, 22 and, in some forms, multiple dimensions, e.g., width and/or height. So configured, with the wired portion 24 received within the retention portion 134 of the front opening 130, the first end 18 of the electrical cord 10 cannot be pulled from the retention housing 120. In the illustrated form, the retention portion 134 extends from a side of the rectangular assembly portion 132 to a dome-shaped end 136. The dome-shaped end 136 can have a diameter generally, e.g., within 0 to 2 mm, equal to a diameter of the wired portion 24 of the electrical cord 10. In one form, the retention portion 134 can be sized to receive the wired portion 24 therein in a friction fit.

As shown in FIGS. 1 and 2, the retention housing 120 can further include a flange 138 that projects outwardly from all or portions of the sidewall 124. In the illustrated form, the flange 138 projects from sides of the retention housing 120 aligned with the end wall 128. Of course, the flange 138 can be disposed at other depths along the retention housing 120. The flange 138 can also provide a convenient finger grip for a user to hold the retention housing 120.

Moreover, the flange 138 can advantageously include one or more slot openings 140 extending therethough and accessible through an edge 142 thereof. The slot openings 140 can be sized to receive the wired portion 24 of the electrical cord 10 therein in a friction fit. So configured, the portions of the electrical cord 10 extending from the assembly 100 can be wrapped around the retention housing 120 and the flange 138 and the slot openings 140 can be utilized to retain the electrical cord 10 in the wrapped configuration.

For some first ends 18, the retention housing 120 will be sized to restrict withdrawal of the first connector 16 from the adapter port 106. In cases where the rear housing of the first connector 16 is smaller than a depth of the housing 120 when the housing 120 is coupled to the adapter 102, however, the space between the first connector 16 and the end wall 128 may undesirably allow a user to unplug or break an electrical connection between the first connector 16 and the adapter 102. Advantageously, the assembly 100 can be provided with spacers 144 that are configured to engage the electrical cord 10 to span a majority of the distance between the first end 18 and the end wall 128, restricting movement of the cord 10 away from the adapter 102. For example, the spacer 144 can extend 75%, 85%, 95%, or 99% of the distance. In another example, the spacer 144 can be sized so that there is minimal, e.g., between 0 and about 5 mm, between 0 and about 3 mm, or between 0 and about 2 mm, gap available for the first end 18 to move. The spacers 144 can have an annular body 146 with a longitudinal slit 148 allowing a user to insert the wired portion 24 of the electrical cord 10 into the annular body 146. In one example, the assembly 100 can be provided with spacers 144 having a range of depths so that any particular electrical cord 10 can be accommodated within the housing 120 with satisfactory results.

Figure 4:
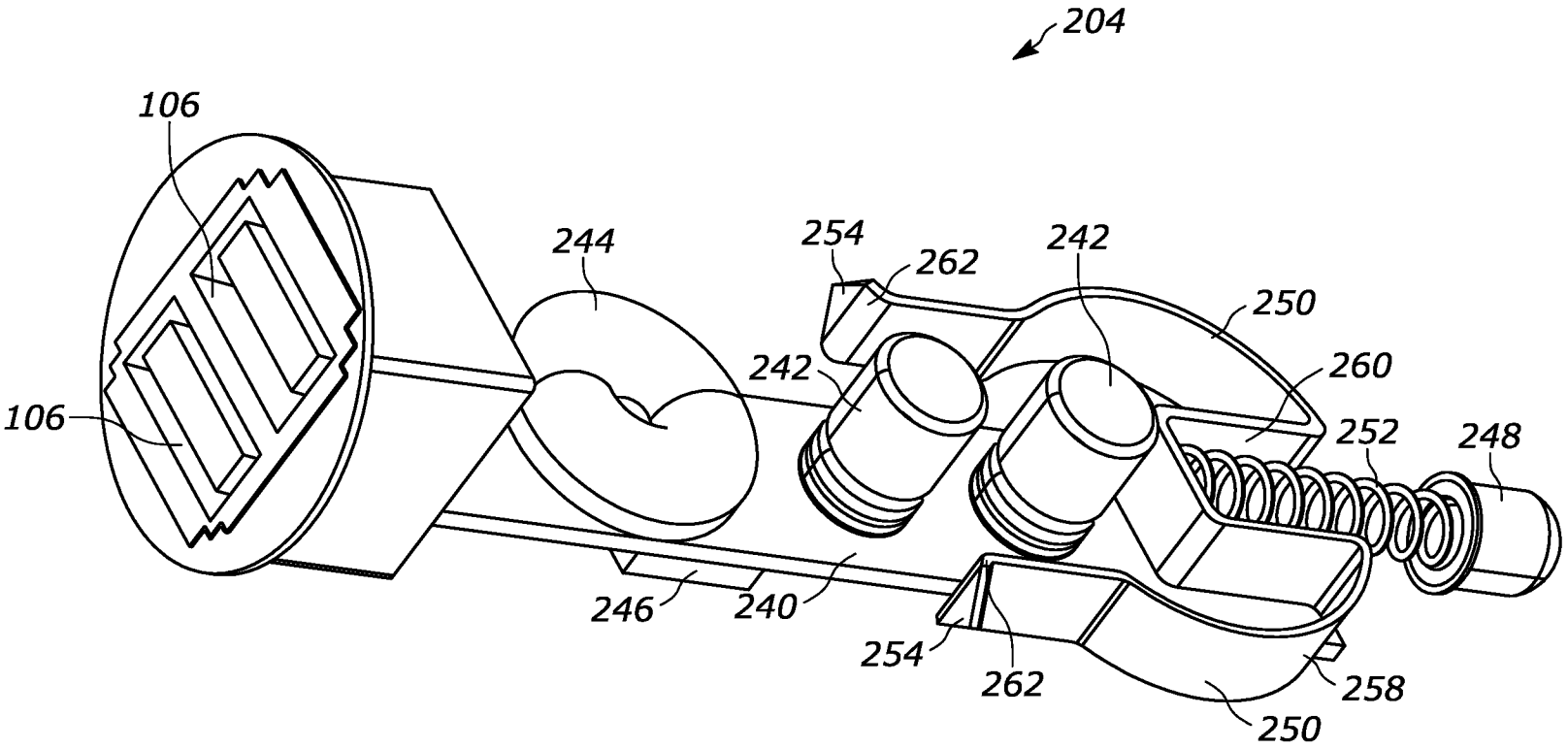
FIG. 4 is an example electronic assembly for a retention assembly in accordance with various embodiments.
Figure 5:
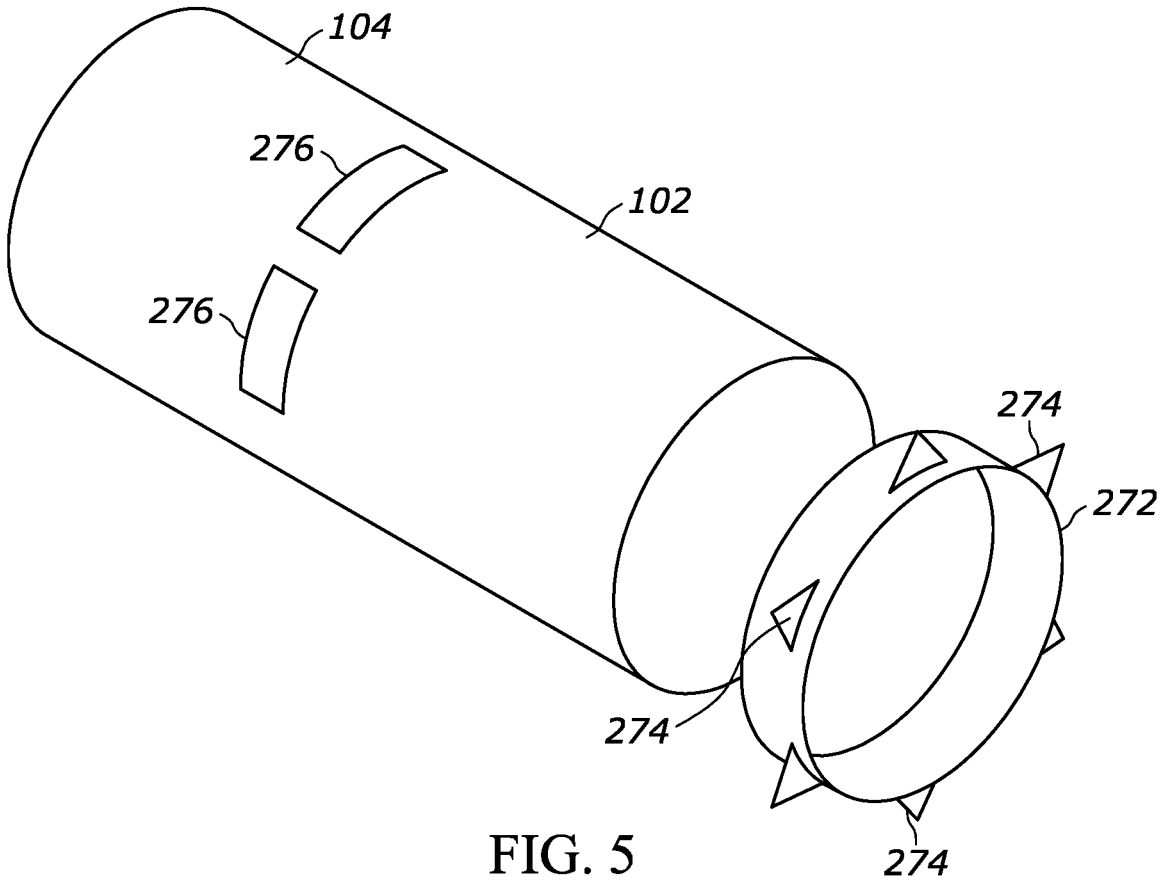
FIG. 5 is a perspective view of a second example retention portion for a retention assembly in accordance with various embodiments.

A first example cord retention assembly 100 for a vehicle or other power outlet is shown in FIGS. 2-4. In this form, the adapter 102 includes a housing 202, an electronic assembly 204, a wedge member 206, and a knob fastener 208. To assemble the adapter 102, the electronic assembly 204 is at least partially disposed within the housing 202, the wedge member 206 is inserted into the housing 202 around and behind the electronic assembly 204, and the fastener 208 is secured to the housing 202 to contain the electronic assembly 204 and the wedge member 206.

As shown, the housing 202 defines an interior 210 with a back opening 212 and a front opening 214. The housing 202 includes a forward, plug portion 216 and an opposite, rear portion 218. A distal end 220 of the plug portion 216 can have a frusto-conical configuration extending to the front opening 214. Further, the plug portion 216 can define radial slot openings 222 disposed on opposite sides of the housing 202 and extending along a length thereof. In the illustrated form, the housing 202 is split longitudinally into first and second components 202*a*, 202*b*, which allows the electronic assembly 204 to be received within an interior 210 defined thereby and the components 202*a*, 202*b* can be secured together by any suitable mechanism, such as snap-fit, adhesive, ultrasonic welding, etc.

The rear portion 218 has a relatively larger diameter than the plug portion 216, so that the rear portion 218 has a larger diameter than the outlet 38. Pursuant to this, the rear portion 218 can include a pair of longitudinally spaced flanges 224, one adjacent to the plug portion 216 and one at a proximal end 226 of the housing 202. In some forms, the rear portion 218 can further include a radially outwardly extending peg or protrusion 228 and an annular wall 230 defining a radially extending threaded bore to secure the retention housing 120 to the adapter housing 202, as will be described in more detail below. Further, the rear portion 218 can include internal threading 234 to threadingly engage the fastener 208.

As shown in FIG. 2, the fastener 208 includes external threading 236 to engage the internal threading 234 of the housing 202. Further, the fastener 208 includes a bore 237 extending longitudinally therethrough and an outwardly extending gripping flange 238. The bore 237 allows components of the electronic assembly 204 to extend the entire length of the adapter 102 with the ports 106 accessible adjacent to an end surface 239 of the fastener 208. The gripping flange 238 allows a user to easily tighten the fastener 208 into the housing 202 and provides a stop for assembly of the adapter 102 when the flange 238 abuts the housing 202.

As shown in FIG. 4, the electronic assembly 204 includes a circuit board 240 having the ports 106 coupled thereto, along with other electrical components, such as capacitors 242, an inductor 244, an integrated circuit 246, and so forth. To electrically couple with the outlet 38, the electronic assembly 204 further includes a cathode contact tip 248 and anode spring arms 250 electrically coupled to the circuit board 240. As shown, the electronic assembly 204 is disposed within the housing 202 so that the contact tip 248 extends distally through the front opening 214 and the spring arms 250 extend radially through the slot openings 222. If desired, the contact tip 248 can be biased distally through the front opening 214 by a spring 252. With this configuration, when the adapter 102 is inserted into the outlet 38, the spring arms 250 engage the outlet sidewall 40 to create an electrical ground contact and the tip 248 subsequently makes contact with the outlet 38 when the adapter 102 is more fully received within the outlet 38.

In this form, the retention portions 110 are pointed tips 254 that are oriented radially to engage the outlet sidewall 40. As set forth above, the fastener 208 can be threaded into the housing 202. Advantageously, the wedge member 206 and fastener 208 can be sized so that threading the fastener 208 into the housing 202 drives the wedge member 206 within the housing 202 and causes a tapered outer surface 256 of the wedge member 206 to deflect the pointed tips 254 radially outwardly to engage the outlet sidewall 40.

In the illustrated form of FIGS. 3 and 4, the spring arms 250 can be provided by an elongate, flat member 258 having a bent configuration with a center portion 260 defining a recess for mounting the spring 252 with the spring arms 250 having a convex configuration extending outwardly from the center portion 260. Further, the pointed tips 254 can be provided at distal ends 262 of the member 258 extending from the spring arms 250. As such, when the adapter 102 is inserted into the outlet 38, the convex configuration of the spring arms 250 causes the arms 250 to contact the outlet sidewall 40, which compresses the convex configuration and drives the distal ends 262 into the wedge member 206. Thereafter, when the fastener 208 is threaded into the housing 202, the tapered surface 256 cams under the distal ends 262 driving the pointed tips 254 into tight engagement with the outlet sidewall 40. In this configuration, the adapter 102 resists removal from the outlet 38. In one example, the elongate member 258 can be formed from hardened steel.

With this configuration, a user can thread one of the ends 18, 22 of the electrical cord 10 through the front opening 130 of the retention housing 120 and plug the first connector 16 into one of the ports 106. Thereafter, a user can secure the retention housing 120 to the housing 202. In one example, the retention housing 120 and the adapter 102 can secure together with a latch mechanism. As shown in FIG. 2, the retention housing 120 includes a slot opening 264 that extends from an edge 266 of the housing sidewall 124 extending around the back opening 126 and turns to extend along a direction generally parallel with the edge 266. With this configuration, the peg 228 of the housing 202 can be inserted into the slot opening 264 through the rear edge 266 as the housing 202 is mounted to the adapter housing 202. A user can then manipulate or twist the retention housing 120 so that the peg 228 slides along the slot opening 264 to dispose a portion of the retention housing 120 between the peg 228 and the rear edge 266 with the peg 228 in a retention position, so that the retention housing 120 cannot be pulled longitudinally away from the adapter housing 202. To further lock the retention housing 120 in place, the assembly 100 can include a lock assembly that includes a fastener 268, such as a screw, an opening 270 in the retention housing 120, and the threaded bore 232 of the housing 202. The fastener 268 locks the rotational position of the housing 120 and prevents the peg 228 from being removed from the slot opening 264. Advantageously, the opening 270 aligns with the threaded bore 232 with the peg 228 the retention position. In other approaches, the retention housing 120 can snap fit or threadingly couple to the housing 202.

In an alternative form, the retention members 110 can be provided by a ring 272 having a plurality or more spikes 274 extending radially outward therefrom. The ring 272 can be coupled to the adapter plug portion 104 to be driven into engagement with the outlet sidewall 40. For example, the wedge member 206 can be utilized to longitudinally drive the ring 272 within the adapter 102. Additionally, rather than opposing slot openings 222, the plug portion 104 can include a plurality of openings 276 disposed in an annular configuration to receive the spikes 274 therethrough.

In other examples, shown in FIGS. 6-9, adapters 300 for the retention assembly 100 are shown that have retention members 110 that can be manipulated to be moved from a storage position disposed at least partially within the plug portion 104 to a retention position with a portion pushed against or through the sidewall 40 of the outlet 38. The retention members 110 can then be locked in the retention position by a movable element 301 that is coupled to the retention members 110. In one form, the moveable element 301 can be a drive member 306 movable longitudinally through the adapter 102. The drive member 306 can be configured to drive the retention members 110 to the retention position and hold the retention members 110 in place. For example, the drive member 306 can be a screw that can be rotated to advance the drive member 306 through the adapter 102. The drive member 306 is operably coupled to the retention members 110, so that the linear movement of the drive member 306 shifts or pivots the retention members 110 radially outwardly from the plug portion 104. The drive member 306 can directly engage the retention members 110 or can drive one or more intermediate members within the plug portion 104, such as an internal wedge or coupling arm. In other examples, the movable element 301 can be a lever arm or threaded collar. The adapters 300 can be configured to have the retention housing 120 secured thereto, such as the latch mechanism and/or locking assembly described above, threading, or snap-fit.

Figure 6:
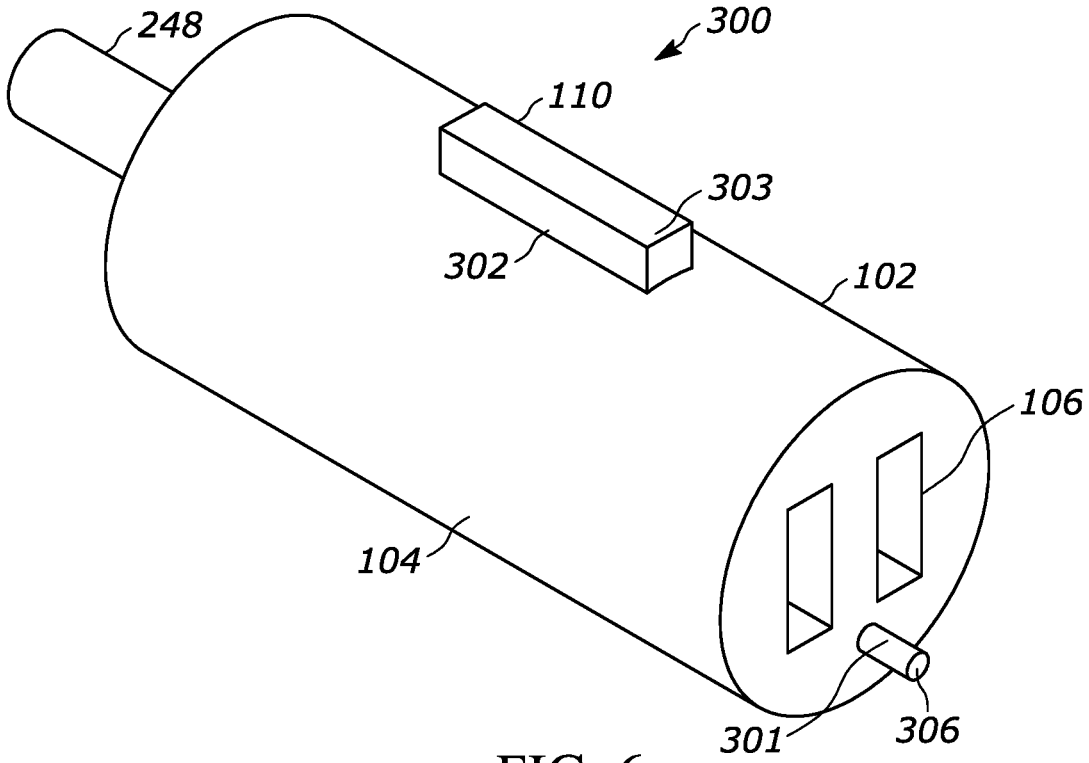
FIG. 6 is a perspective view of a second example retention assembly in accordance with various embodiments.
Figure 7:
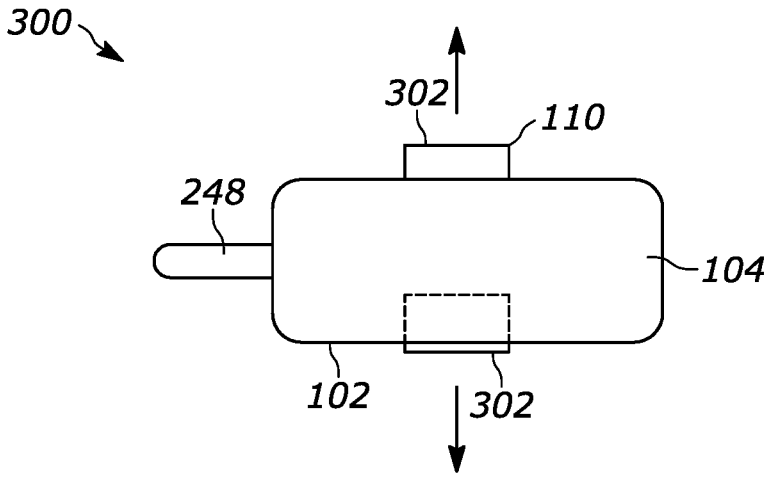
FIG. 7 is a schematic top plan view of the retention assembly of FIG. 6 showing retentions portions extending radially outwardly.

As shown in FIGS. 6 and 7, the retention assembly 300 can include the retention members 110 in the form of gripping members 302 extending radially outwardly from the plug portion 104. In some examples, the gripping members 302 can be made from a suitably tacky material or have a tacky material disposed thereon, such as rubber, a polymer or blend of polymers, adhesive, and so forth. In other examples, the gripping members 302 can have a textured engagement surface or tacky layer disposed thereon. Preferably, the gripping members 302 extend to a diameter greater than a diameter of the outlet sidewall 40, such that moving the gripping members 302 to the retention position causes the gripping members 302 to compress against the outlet sidewall 40. The gripping member 302 may be sized so that an engagement surface 303 creates a friction force to resist removal of the adapter 102 from the outlet 38. The gripping members 302 can have any desired shape, such as an elongated box as shown, or other polygonal and/or curvilinear shapes. In an alternative form, the gripping members 302 can be fixedly mounted to the plug portion 104, such that inserting the adapter 102 into the outlet 38 causes the gripping members 302 to compress between the outlet sidewall 40 and the plug portion 104 of the adapter 102.

Figure 8:
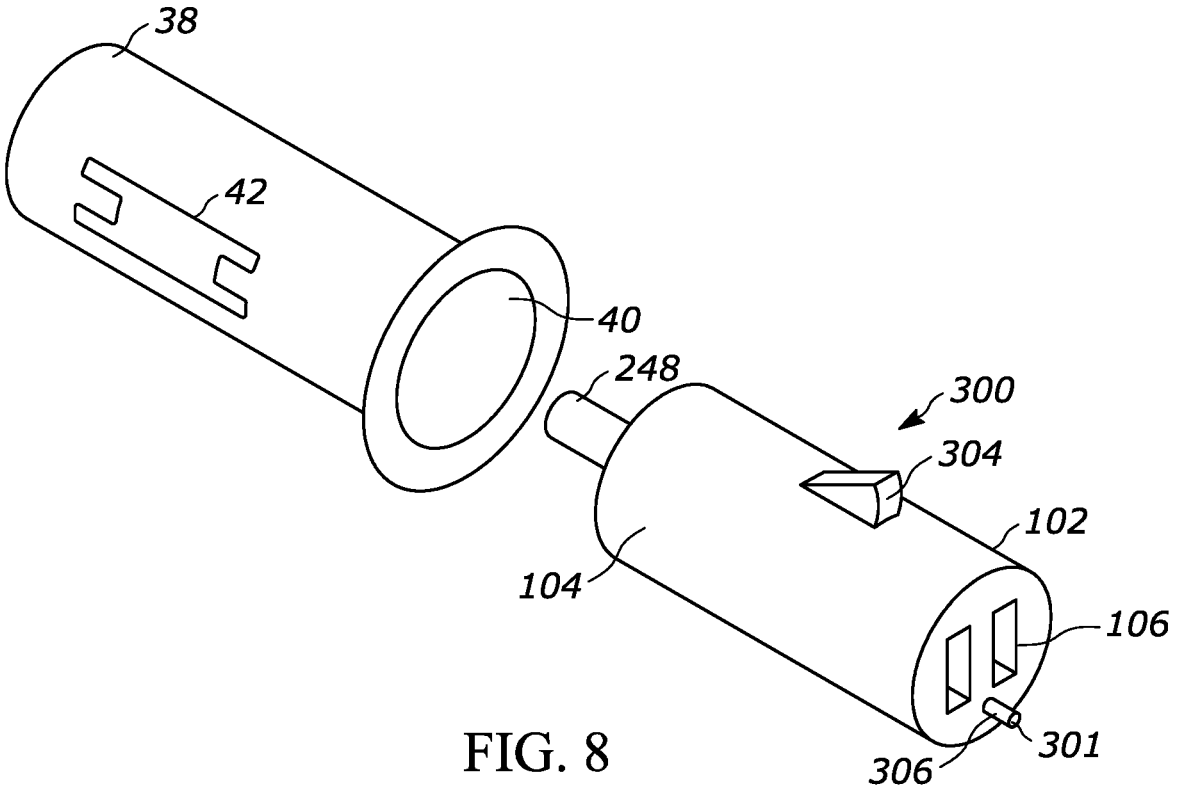
FIG. 8 is an exploded view of a third example retention assembly in accordance with various embodiments.
Figure 9:
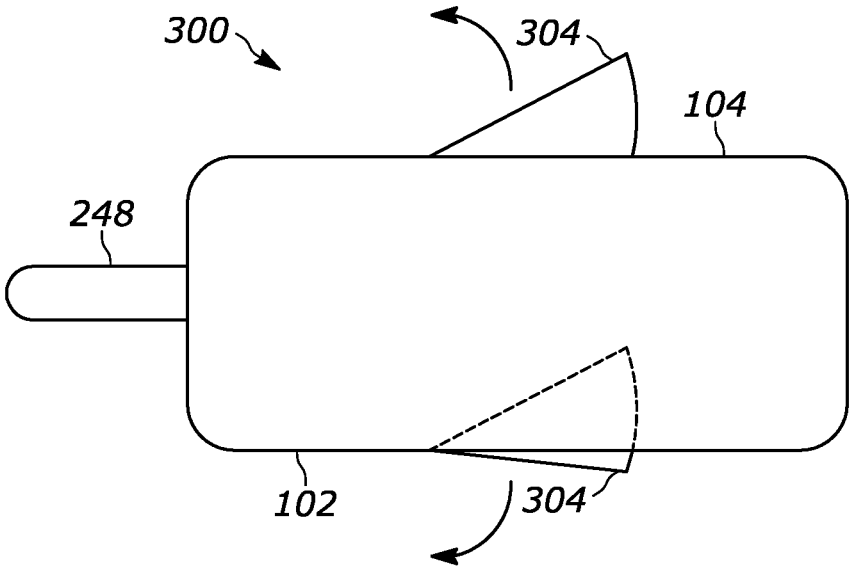
FIG. 9 is a schematic top plan view of the retention assembly of FIG. 8 showing retentions portions extending radially outward.
Figure 10:
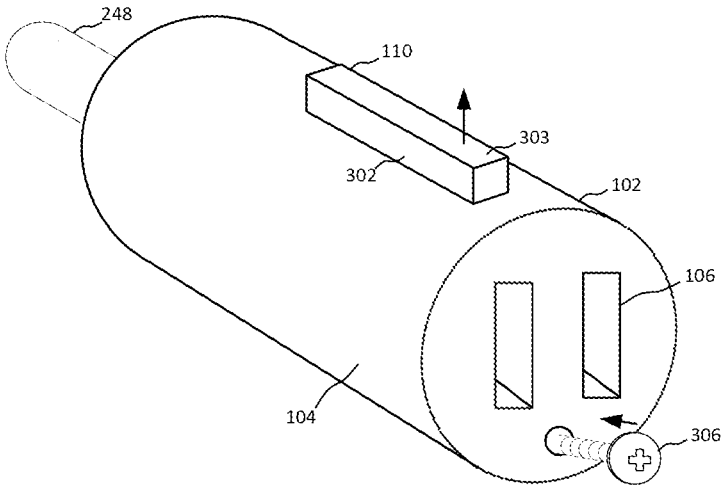
FIG. 10 is a drawing showing a drive member comprising a screw.

As shown in FIGS. 8 and 9, the retention assembly 300 can include the retention members 110 in the form of pivoting wings 304 that are pivotable between the storage position and the retention position engaging the outlet sidewall 40. For some outlets 38, the sidewall 40 can include holes 42 extending therethrough. The holes 42 typically extend along a longitudinal length of the sidewall 40 as shown. The wings 304 can be configured to extend into the holes 42 in the retention position, such that wings 304 will abut the sidewall 40 when a user attempts to remove the adapter 102 from the outlet 38. Although the drive member 306 is shown, the wings can alternatively be biased to the retention position by a spring or other resilient member, or can utilize a lever arm and/or threaded collar.

It should be appreciated that the foregoing components can be made by any suitable process, such as by injection or blow molding, 3D printing, casting, machining, or any other practical and available means known to those skilled in the art. Moreover, it will be understood that a method of retaining the first end 18 of the electrical cord 10 to the outlet 38 is described using any of the retention assemblies 100, 300 described above.

It will be appreciated that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. The same reference numbers may be used to describe like or similar parts. Further, while several examples have been disclosed herein, any features from any examples may be combined with or replaced by other features from other examples. Moreover, while several examples have been disclosed herein, changes may be made to the disclosed examples within departing from the scope of the claims.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A retention assembly for retaining a first end of an electrical cord in engagement with an electrical outlet, the retention assembly comprising:

an adapter including a housing having a cylindrical plug portion;

retention members of the adapter extending radially outwardly from the cylindrical plug portion of the housing to engage a sidewall of the electrical outlet and cause the adapter to resist removal from the electrical outlet;

an electronic assembly comprising a port configured to receive a plug of the first end of the electrical cord and contacts to electrically engage the electrical outlet; and a retention housing configured to couple to the adapter, the retention housing comprising one or more walls defining a back opening, a front opening, and an interior sized to receive the first end of the electrical cord, wherein the front opening includes a portion having a dimension smaller than a dimension of the first end to thereby retain the first end of the electrical cord within the retention housing; wherein the retention members comprise pointed tips oriented radially.

2. The retention assembly of claim 1, wherein the adapter further comprises a wedge member movable within the housing to drive the pointed tips radially outward to engage the sidewall of the outlet.

3. The retention assembly of claim 2, wherein the wedge member has an annular configuration.

4. The retention assembly of claim 2, wherein the adapter further comprises a fastener configured to couple to the housing, wherein coupling the fastener to the housing drives the wedge member longitudinally within the housing to drive the pointed tips radially outward.

5. The retention assembly of claim 4, wherein the fastener defines a bore extending longitudinally therethrough providing access to the port of the electronic assembly.

6. The retention assembly of claim 1, wherein the electronic assembly further comprises radially-extending spring arms providing an anode contact; the pointed tips are disposed at distal ends of the spring arms; and the cylindrical plug portion of the housing defines radial slot openings configured to receive the spring arms and pointed tips therethrough.

7. The retention assembly of claim 1, further comprising a drive member operably coupled to the retention members, wherein the retention members are at least partially disposed within the cylindrical plug portion of the housing; and wherein the drive member is configured to drive the retention members from a storage position with the retention members at least partially disposed within the cylindrical plug portion of the housing to a retention position with the retention members engaging the sidewall of the electrical outlet.

8. The retention assembly of claim 7, wherein the retention members comprises gripping members formed from a tacky, compressible material, the gripping members configured to shift radially outwardly to the retention position.

9. The retention assembly of claim 1, wherein the retention members comprise wings pivotably mounted to the cylindrical plug portion.

10. The retention assembly of claim 7, wherein the drive member comprises a screw configured to be rotated to move longitudinally through the housing to drive the retention members to the retention position.

11. The retention assembly of claim 1, further comprising a latch mechanism coupling the retention housing to the housing of the adapter.

12. The retention assembly of claim 11, wherein the latch mechanism comprises a peg of the adapter extending radially outwardly from the housing thereof and a slot opening of the retention housing having a first end open along an edge thereof and a second end extending generally along the edge, such that the retention housing and adapter can be moved relative to one another to position the peg in the second end of the slot opening to thereby restrict longitudinal movement of the retention housing away from the adapter.

13. The retention assembly of claim 12, further comprising a lock assembly comprising a threaded bore of the adapter, a through opening of the retention housing, and a fastener, wherein the threaded bore and the through opening align with the peg in the second end of the slot opening.

14. The retention assembly of claim 1, wherein the one or more walls of the retention housing comprises an end wall having the front opening extending therethrough, the front opening including an assembly portion sized to receive the first end or a second end of the electrical cord therethrough and a smaller, retention portion sized to receive a wire portion of the electrical cord therein, wherein the retention portion is configured to align along an axis of the port.

15. The retention assembly of claim 14, wherein the retention portion comprises a dome-shaped portion having a diameter generally equal to a diameter of a wired portion of the electrical cord.

16. The retention assembly of claim 14, wherein the assembly portion comprises a rectangular opening.

17. The retention assembly of claim 1, wherein the retention housing further comprises an outwardly projecting flange.

18. The retention assembly of claim 17, wherein the flange includes one or more slot openings extending there- 5 through sized to retain a wired portion inserted—therein.

* * * * *